US010511110B2

(12) United States Patent
Pizzi

(10) Patent No.: US 10,511,110 B2
(45) Date of Patent: Dec. 17, 2019

(54) ELECTRIC SWITCHBOARD TERMINAL BLOCK WITH MULTIPLE LABEL-HOLDER SEATS

(71) Applicant: MORSETTITALIA S.P.A., Milan (IT)

(72) Inventor: Giordano Pizzi, Milan (IT)

(73) Assignee: MORSETTITALIA S.P.A., Milan (IT)

( * ) Notice: Subject to any disclaimer, the term of this patent is extended or adjusted under 35 U.S.C. 154(b) by 0 days.

(21) Appl. No.: 16/028,590

(22) Filed: Jul. 6, 2018

(65) Prior Publication Data

US 2019/0013602 A1 Jan. 10, 2019

(30) Foreign Application Priority Data

Jul. 7, 2017 (IT) ..... 102017000076710

(51) Int. Cl.

| | |
|---|---|
| ***H01R 9/26*** | (2006.01) |
| ***H01R 9/24*** | (2006.01) |
| ***H01R 4/48*** | (2006.01) |
| ***H01R 13/46*** | (2006.01) |

(52) U.S. Cl.

CPC ..... *H01R 9/2683* (2013.01); *H01R 4/4845* (2013.01); *H01R 9/2475* (2013.01); *H01R 9/2608* (2013.01); *H01R 9/2675* (2013.01); *H01R 13/465* (2013.01); *H01R 9/26* (2013.01)

(58) Field of Classification Search

CPC ..... H01R 13/465; H01R 9/2475; H01R 9/24; H01R 9/2683; H01R 9/2608; H01R 9/2675; H01R 9/26; H01R 4/4845

USPC ..... 439/491, 709

See application file for complete search history.

(56) References Cited

U.S. PATENT DOCUMENTS

| | | | | |
|---|---|---|---|---|
| 4,171,861 A | | 10/1979 | Hohorst | |
| 5,419,715 A | * | 5/1995 | Laveissiere | H01R 9/2683 439/491 |
| 6,146,213 A | * | 11/2000 | Yoon | H01R 9/2616 439/532 |
| 8,517,758 B2 | * | 8/2013 | Pizzi | H01R 9/2683 439/491 |

(Continued)

FOREIGN PATENT DOCUMENTS

| | | |
|---|---|---|
| DE | 102008058871 B3 | 6/2010 |
| EP | 2214267 A1 | 8/2010 |

(Continued)

OTHER PUBLICATIONS

Search Report for Related Italian App. 102017000076710 dated May 14, 2018.

*Primary Examiner* — Gary F Paumen

(57) ABSTRACT

Electric switchboard terminal block having a body (310) extending in a lengthwise longitudinal direction (X-X), widthwise transverse direction (Y-Y) and heightwise vertical direction (Z-Z), and comprising a front face (310*a*) and lateral flanks (310*b*) situated opposite each other in the longitudinal direction (X-X), each flank having a first seat (320) for housing a label (30), and comprising a recess (330) with a substantially trapezium-like vertical cross-section arranged in a central position in the longitudinal direction (X-X) and having a greater base open on the front face (310*a*) of the terminal block and smaller base open towards the inside thereof, said recess (330) having at least one further seat (331;333) for housing at least one additional label (30).

21 Claims, 2 Drawing Sheets

(56) References Cited

U.S. PATENT DOCUMENTS

Figure 1:
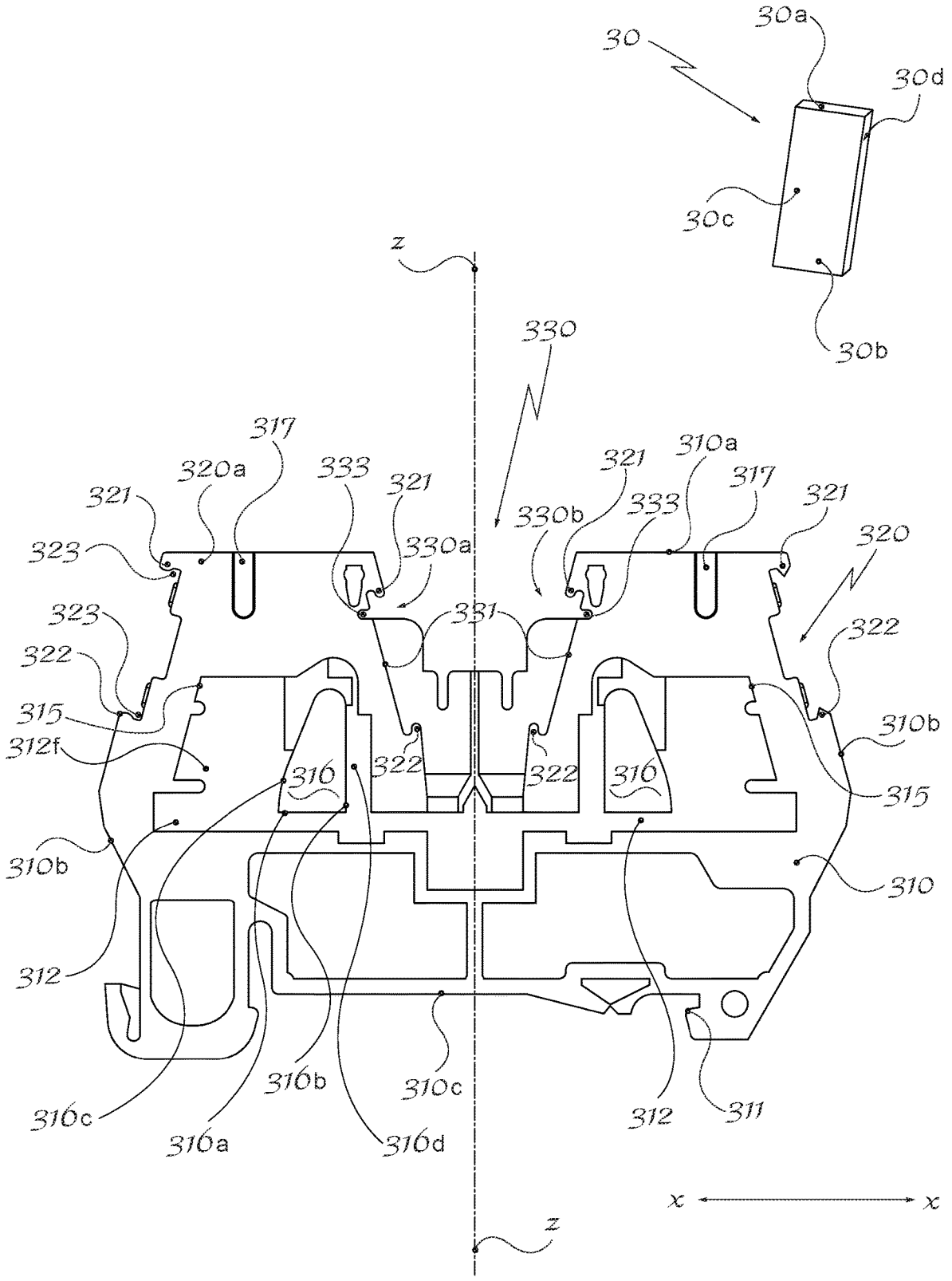

| | | | | |
|---|---|---|---|---|
| 2006/0086530 | A1* | 4/2006 | Knabel | H01R 25/16 174/135 |
| 2008/0233782 | A1* | 9/2008 | Hoppmann | H01R 4/4827 439/259 |
| 2011/0183542 | A1* | 7/2011 | Pizzi | H01R 9/2683 439/491 |
| 2016/0233593 | A1* | 8/2016 | Pizzi | H01R 9/26 |
| 2017/0117643 | A1* | 4/2017 | Pizzi | G09F 3/205 |

FOREIGN PATENT DOCUMENTS

| | | | |
|---|---|---|---|
| EP | 2355251 | A1 | 8/2011 |
| EP | 3133698 | A1 | 2/2017 |
| FR | 2362505 | A1 | 3/1978 |

* cited by examiner

ELECTRIC SWITCHBOARD TERMINAL BLOCK WITH MULTIPLE LABEL-HOLDER SEATS

The present invention relates to an electric switchboard terminal block provided with a plurality of label-holder seats.

It is known in the technical sector relating to the construction of switchboards for the wiring of electrical installations to use terminal blocks adapted to be mounted on associated mounting rails and to provide access on the front to the means—normally of the screw and/or spring type—for retaining the electric connection wires which form the electrical circuit. EP 2355251A1 illustrates an example of an electric switchboard terminal block with a body extending in a longitudinal direction (length), transverse direction (width) and vertical direction (height) and comprising: a front face and side flanks situated opposite each other in the longitudinal direction, each flank having a first seat for housing a label, and a recess arranged in a central position in the longitudinal direction, open in the vertical direction on the front face of the terminal block and extending towards the inside thereof. With this configuration it is possible to apply labels which are visible only from the sides of the terminal block.

EP 3133698A1 describes an example of a label for marking switchboard terminal blocks, which comprises a rigid base on which a flexible film is mounted, wherein the rigid base has a top side with first and second arms having a respective inwardly directed projection and a bottom side which has two legs extending in the opposite direction to the arms for insertion in a corresponding seat of a terminal block.

The increasingly greater complexity of electric switchboards results however in the need to apply on each terminal block corresponding identification labels which must be visible different angles, in particular from the front, for each wiring configuration in order to allow reading by the user and thus correct identification of the wire to be managed.

The technical problem which is posed therefore is to provide a terminal block for electric switchboards able to allow identification of a plurality of wiring elements by the user when viewing the block from different angles. It is furthermore desirable that the terminal block should have a plurality of seats for containing respective identification labels such that the latter may be engaged/disengaged in an easy and efficient manner, while ensuring safety characteristics and good visibility and preventing accidental removal of the label.

In connection with this problem it is also required that this terminal block should be easy and inexpensive to produce and assemble.

These results are obtained according to present invention by an electric switchboard terminal block comprising a plurality of label seats according to the characteristic features of claim 1.

Figure 2:
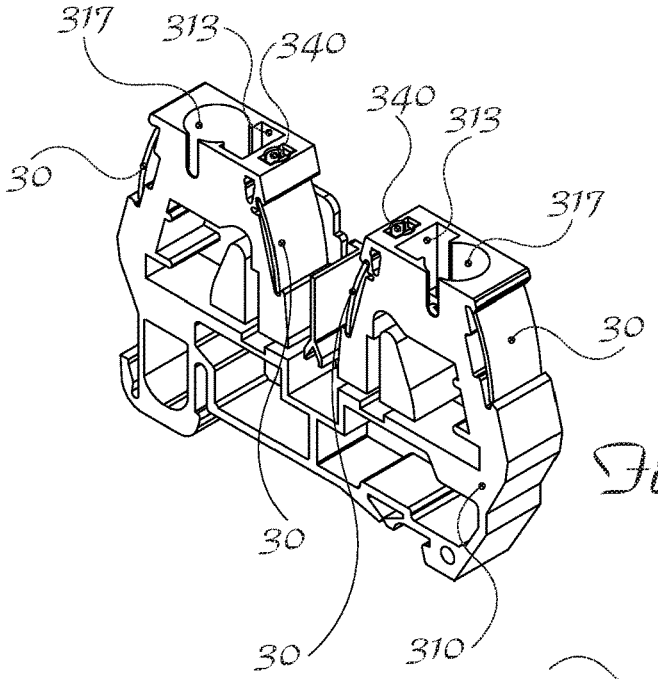
Figure 3:
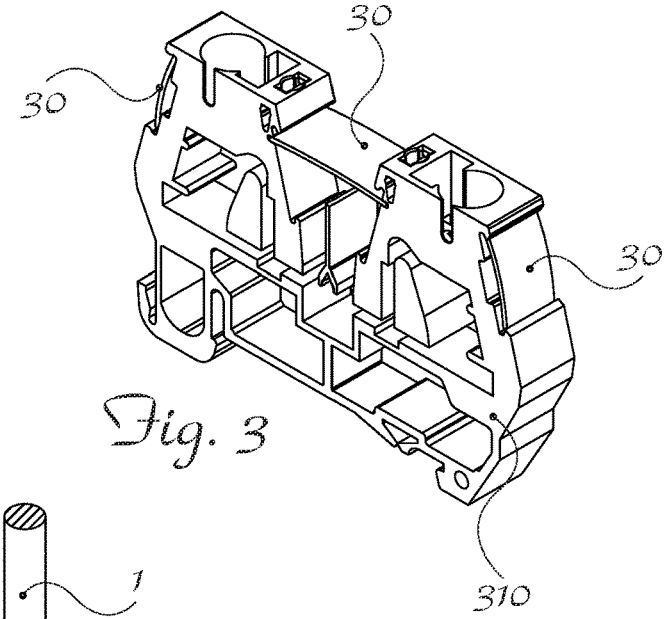
Figure 4:
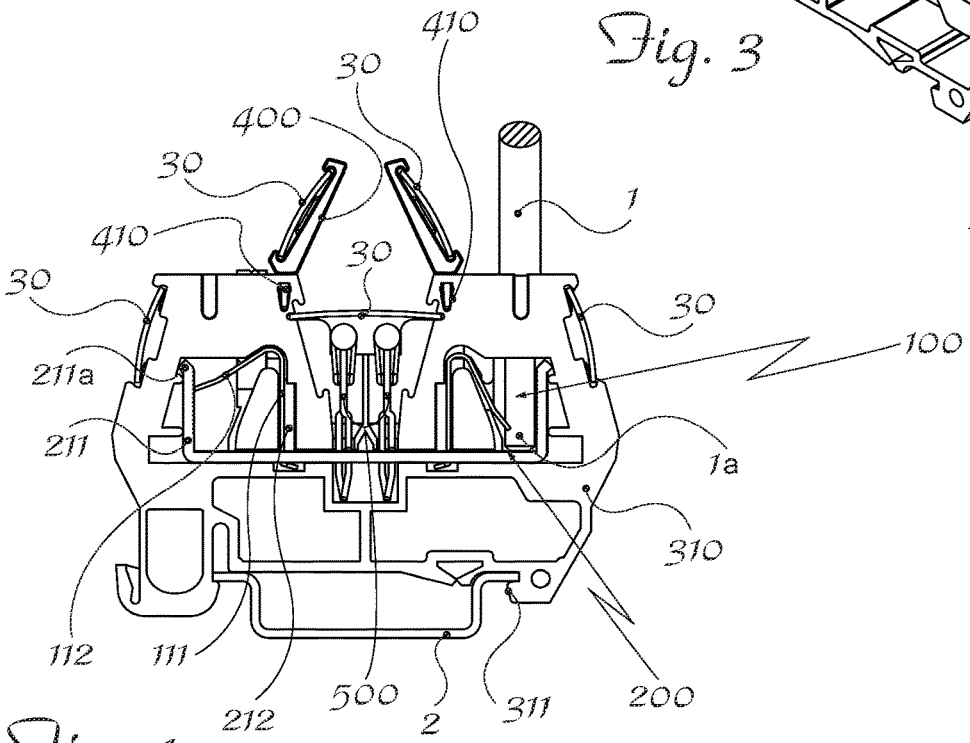

Further details may be obtained from the following description of a non-limiting example of embodiment of the subject of the present invention provided with reference to the attached drawings in which:

FIG. 1: shows a side view of an open terminal block with label-holder seats according to the present invention;

FIG. 2: shows a perspective view of the terminal block according to FIG. 1 with a first example of a label arrangement;

FIG. 3: shows a perspective view of the terminal block according to FIG. 1 with a second example of an identification label arrangement;

FIG. 4: shows a side view of a further configuration of the terminal block/label assembly according to the present invention.

As shown and assuming only for the sake of easier description and without a limiting meaning a set of three reference axes in a longitudinal direction X-X (length), transverse direction Y-Y (width) and vertical direction Z-Z (height), a switchboard terminal block for connecting electric wires according to the present invention comprises essentially:

an insulating body 310 (FIG. 4) forming the container for electrical connection components inside the terminal block, in the example consisting of a conductor element 200 for connecting together the input IN and output OUT of the terminal block, with which the means 100 for retaining the free end 1*a* of electric wires 1 are associated (FIG. 4).

In greater detail said insulating body 310 has a frame formed so as to define at least one front face 310*a*, at least two respective flanks 310*b* situated opposite each other, and means 311 for engagement with a DIN rail 2 which are formed on a rear face 310*c* opposite to the said front face 310*a* in the longitudinal direction X-X.

The following are formed inside the body 310:

- a first pair of seats 312 open in the transverse direction Y-Y and symmetrical with respect to a central axis parallel to the vertical direction Z-Z;
- a pair of second seats 315 each formed on the inner wall of each flank 310*b*, open towards the inside of the corresponding first seat 312; the second seats are in turn symmetrical with respect to the axis Z-Z and designed to house (see FIG. 4) a respective slanting free end 211*a* of the arm 211 of the contact strip 200, so as to ensure stable retention of the conductor element 200 in the insulating body 310.

The seats 312 have, arranged inside them, a substantially trapezoidal body 316 with a height 316*b* parallel to the vertical direction Z-Z, a larger base 316*a* parallel to the longitudinal direction X-X, and having an inclined face 316*c* directed towards the respective side face 310*b* of the terminal block; the body 316 is arranged inside the seat in a longitudinal position such as to form a first recess 316*d* designed to contain a shoulder 212 of the conductor element 200 and the first vertical arm 111 of the spring 100 (FIG. 4); and a second recess 316*f* designed to contain the second arm 112 of the spring 100; during use the inclined flank 316*c* of the body 316 forms an end-of-travel stop for resilient deformation of the said second arm 112 the spring 100.

On the front face 310*a* of the frame 310 the following are also formed (see FIG. 2):

- a pair of first openings 313 extending in the vertical direction Z-Z, substantially superimposed on the respective seat 312 and designed to place said seats in communication with the outside for introduction of a tool or special button for operating the spring 100 gripping the wire 1;
- a pair of holes 317 with a vertical axis Z-Z arranged in a more outer position with respect to said first openings 313 in the longitudinal direction X-X and connected to the respective seat 312 with which they communicate for introduction of the wire 1 in the vertical direction Z-Z;
- each side flank 310*b* of the terminal block has, formed thereon, a seat 320 for holding a label 30, which has (see FIG. 1) a top edge 320*a* and bottom edge 320*b* formed as a respective tooth 321,322 extending widthwise in the transverse direction of the said seat 320, each tooth forming a corresponding undercut 323.

Preferably, said teeth 321,322 situated opposite each other have a suitably rounded edge.

In its central part along the longitudinal direction X-X the terminal block has a recess 330, open on the front face 310*a* of the terminal block and on the opposite side open towards the inside thereof, said recess being suitable (see FIG. 4) for the insertion of jumpers 500 for electrically connecting together several terminal blocks in the transverse direction.

In a preferred embodiment, shown in the figures by way of example, the recess 330 has a vertical cross-section substantially in the form of a trapezium with the larger base open towards the front face 310*a* and smaller base open towards the inside of the terminal block; the recess also has opposite inclined faces 330*a*,330*b* slanting from outwards inwards and from the flanks 310*b* towards the central vertical axis Z-Z.

Each inclined face 330*a*,330*b* of the recess 330 has, formed thereon, a further second seat 331 for holding labels 30, preferably having characteristics similar to those already described in connection with the label-holder seats of the flanks 310*b*.

Although the recess is described as having a trapezium-like form for facilitating reading of the labels arranged on its inclined sides, it is within the competence of the person skilled in the art to design the recess with different forms provided that they allow the labels to be read, even with difficulty.

Preferably, at each end close to the respective top tooth 321, each second seat 331 has an incision 333 extending in the longitudinal direction X-X and in turn able to receive the opposite edges 30*a* and 30*b* of a further label 30 directed along a longitudinal-transverse plane (X-Y). Preferably, the recess 330 comprises a bottom zone (close to the smaller base) suitable for containing the jumpers, the incisions 333 being arranged at a height in the vertical direction outside of this bottom zone and between the latter and the front face such that, during use, the label arranged in the longitudinal-transverse plane (X-Y) is arranged above the jumpers which are already mounted and does not interfere with them.

Preferably (FIG. 2), the front face 310*a* of the terminal block has, formed therein, a pair of holes 340 suitable for inserting (FIG. 4) the base lug 30 410 of an auxiliary element 400 for holding labels 30 useful for improving identification of the terminal block connections when jumpers are present. In the preferred embodiment shown, each hole 34 is arranged between the respective first opening 313 and the recess 330.

According to preferred embodiments each label has an inner face 30*c*, outer reading/writing face 30*d* and a top edge 30*a* and bottom edge 30*bn* shaped so as to form a respective projection; the projections extend substantially over the entire width of the label in the widthwise transverse direction Y-Y, the dimensions thereof corresponding to those of the corresponding seats 320,321 of the terminal block, ensuring optimum engagement of the label. During use the terminal block/label assembly is assembled by inserting the bottom edge 30*b* of the label into the bottom undercut 323 of the first lateral seat 320 so that the bottom tooth 322 of the same interferes with the bottom edge 30*b* of the label 30; once the respective bottom edges have been engaged, the label 30 is pushed frontally in the longitudinal direction X-X so as to force insertion of the top edge 30*a* of the label inside the top seat 323 of the receiving slot 320 of the terminal block, causing interference between the top tooth 321 and the edge 30*a* of the label; engagement together frontally is facilitated by the small relative sliding friction of the surfaces due to the rounded form of the teeth and the projections which come into contact with each other.

In order to extract the labels applied to the flanks 310, the tip of a tool is inserted between the seat 320 and the label 30 so as to cause separation of the label which may be extracted without too much difficulty, also owing to the small amount of friction between the rounded teeth and the elasticity of the label; in addition, the possibility of using a tool on the rear side of the label avoids damaging the label which may be used again.

By means of a similar action it is possible to extract the other labels from the respective seats, including the seat arranged horizontally inside the recess 330.

It is therefore clear how the terminal block according to the invention is easy and inexpensive to produce and is suitable for the application of a plurality of labels which may be viewed and read from several directions by the user.

The labels may be easily applied and removed, while being able to be positioned in a stable and therefore secure and reliable manner.

Although described in connection with a number of embodiments and a number of preferred examples of implementation of the invention, it is understood that the scope of protection of the present patent is determined solely by the claims below.

The invention claimed is:

1. An electric switchboard terminal block having a body (310) extending in a lengthwise longitudinal direction (X-X), widthwise transverse direction (Y-Y) and heightwise vertical direction (Z-Z), and comprising a front face (310*a*) and side flanks (310*b*) situated opposite each other in the longitudinal direction (X-X), each flank having a first seat (320) for housing a label (30), and a recess (330) arranged in a central position in the longitudinal direction (X-X), open in the vertical direction (Z-Z) on the front face (310*a*) of the terminal block and open, on the opposite side, towards an inside of the terminal block, wherein said recess (330) has at least one further seat (331;333) for housing at least one additional label (30), and wherein said recess (330) has a substantially trapezium-like vertical cross-section with a larger base open towards the front face (310*a*) and a smaller base open towards the inside of the terminal block; the recess also having opposite inclined faces (330*a*,330*b*) slanting from the outside toward the inside and from the flanks (310*b*) towards a central vertical axis (Z-Z).

2. The terminal block according to claim 1, wherein said at least one further seat (331;333) comprises a seat oriented in a longitudinal-transverse plane (X-Y) defined by a pair of incisions (333), each extending in the longitudinal direction (X-X) in a respective inclined face (330*a*,330*b*) of the central recess (330), for receiving the opposite edges of an additional label (30) oriented in the longitudinal-transverse plane (X-Y).

3. The terminal block according to claim 2, wherein each incision (333) is formed at an end close to the front face (310*a*) of the respective inclined face (330*a*,330*b*) of the central recess (330).

4. The terminal block according to claim 1, wherein said at least one further seat comprises a first seat and a second seat (331) each formed in a respective inclined face (330*a*, 330*b*) of the central recess (330).

5. The terminal block according to claim 1, wherein said first seat (320) and/or said at least one further seat (331) have a top edge (320*a*) and bottom edge (320*b*) formed in the manner of a respective tooth (321,322), each tooth forming a corresponding undercut (323) towards the inside of the receiving slot.

6. The terminal block according to claim 1, wherein one or more of the first seat and/or at least one further seat is/are open in the transverse direction (Y-Y) for insertion of the label.

7. The terminal block according to claim 5, wherein each tooth (321,322) of a seat extends over the width in the transverse direction (Y-Y) of the seat.

8. The terminal block according to claim 5, wherein said teeth (321,322) of the seats are situated opposite each other and have a rounded free edge.

9. The terminal block according to claim 2, wherein the central recess (330) comprises a bottom zone in the vertical direction (Z-Z) able to contain one or more connecting jumpers (500), the longitudinal incisions (333) of the at least one further seat oriented in a longitudinal-transverse plane (X-Y) being arranged in the vertical direction between the bottom zone and the front face such that, during use, the at least one further seat oriented in the longitudinal-transverse plane (X-Y) is situated above the already mounted jumpers (500).

10. The terminal block according to claim 1, wherein the front face (310*a*) of the terminal block has, formed in it, a pair of holes (340) for insertion of a base lug (410) of an auxiliary (330) label-holder (30) identification element (400).

11. The terminal block according to claim 10, wherein each hole (340) for receiving the base lug of an auxiliary label-holder element is arranged between a respective first opening (313) extending in the vertical direction (Z-Z) for the introduction of a tool or special button for operating wire-gripping means, and the central recess (330).

12. An electric switchboard terminal block having a body (310) extending in a lengthwise longitudinal direction (X-X), widthwise transverse direction (Y-Y) and heightwise vertical direction (Z-Z), and comprising a front face (310*a*) and side flanks (310*b*) situated opposite each other in the longitudinal direction (X-X), each flank having a first seat (320) for housing a label (30), and a recess (330) arranged in a central position in the longitudinal direction (X-X), open in the vertical direction (Z-Z) on the front face (310*a*) of the terminal block and open, on the opposite side, towards an inside of the terminal block, wherein said recess (330) has at least one further seat (331;333) for housing at least one additional label (30); and wherein said first seats (320) and/or said at least one further seat (331) have a top edge (320*a*) and a bottom edge (320*b*) formed in the manner of a respective tooth (321,322), each tooth forming a corresponding undercut (323) towards the inside of the receiving slot.

13. The terminal block according to claim 12, wherein said at least one further seat (331;333) comprises a seat oriented in a longitudinal-transverse plane (X-Y) defined by a pair of incisions (333), each extending in the longitudinal direction (X-X) in a respective inclined face (330*a*,330*b*) of the central recess (330), for receiving the opposite edges of an additional label (30) oriented in the longitudinal-transverse plane (X-Y); and wherein said recess (330) has a substantially trapezium-like vertical cross-section with a larger base open towards the front face (310*a*) and a smaller base open towards the inside of the terminal block; the recess also having opposite inclined faces (330*a*,330*b*) slanting from the outside toward the inside and from the flanks (310*b*) towards a central vertical axis (Z-Z).

14. The terminal block according to claim 13, wherein each incision (333) is formed at an end close to the front face (310*a*) of the respective inclined face (330*a*,330*b*) of the central recess (330).

15. The terminal block according to claim 12, wherein said at least one further seat comprises a first seat and a second seat (331) each formed in a respective inclined face (330*a*,330*b*) of the central recess (330).

16. The terminal block according to claim 12, wherein one or more of the first seats and/or at least one further seat is/are open in the transverse direction (Y-Y) for insertion of the label.

17. The terminal block according to claim 12, wherein each tooth (321,322) of a seat extends over the width in the transverse direction (Y-Y) of the seat.

18. The terminal block according to claim 12, wherein said teeth (321,322) of the seats are situated opposite each other and have a rounded free edge.

19. The terminal block according to claim 13, wherein the central recess (330) comprises a bottom zone in the vertical direction (Z-Z) able to contain one or more connecting jumpers (500), the longitudinal incisions (333) of the further seat oriented in a longitudinal-transverse plane (X-Y) being arranged in the vertical direction between the bottom zone and the front face such that, during use, the further seat oriented in the longitudinal-transverse plane (X-Y) is situated above the already mounted jumpers (500).

20. The terminal block according to claim 12, wherein the front face (310*a*) of the terminal block has, formed in it, a pair of holes (340) for insertion of a base lug (410) of an auxiliary (330) label-holder (30) identification element (400).

21. The terminal block according to claim 20, wherein each hole (340) for receiving the base lug of an auxiliary label-holder element is arranged between a respective first opening (313) extending in the vertical direction (Z-Z) for the introduction of a tool or special button for operating wire-gripping means, and the central recess (330).

* * * * *